United States Patent [19]

Pascal et al.

[11] Patent Number: 5,002,300

[45] Date of Patent: Mar. 26, 1991

[54] SKI WITH DISTRIBUTED SHOCK ABSORPTION

[75] Inventors: Roger Pascal, Annecy le Vieux; Gilles Recher, Annecy, both of France

[73] Assignee: Salomon S.A., Annecy Cedex, France

[21] Appl. No.: 156,962

[22] Filed: Feb. 18, 1988

[30] Foreign Application Priority Data

Feb. 27, 1987 [FR] France ..... 87 03117

[51] Int. Cl.[5] ..... A63C 5/04

[52] U.S. Cl. ..... 280/602; 280/610

[58] Field of Search ..... 280/609, 610, 601, 602

[56] References Cited

U.S. PATENT DOCUMENTS

| | | | |
|---|---|---|---|
| 3,901,522 | 8/1975 | Boehm | 280/610 |
| 4,383,701 | 5/1983 | Hirnbock et al. | 280/610 |
| 4,405,149 | 9/1983 | Piegay . | |
| 4,412,687 | 11/1983 | Andre . | |
| 4,433,855 | 2/1984 | Wyke | 280/609 |
| 4,537,417 | 8/1985 | Hirnbock et al. | 280/602 |
| 4,627,635 | 12/1986 | Koleda | 280/809 X |
| 4,639,009 | 1/1987 | Meatto et al. | 280/610 |
| 4,697,820 | 10/1987 | Hayashi et al. . | |
| 4,722,543 | 2/1988 | Brugger | 280/609 |

FOREIGN PATENT DOCUMENTS

| | | | |
|---|---|---|---|
| 0193519 | 11/1986 | European Pat. Off. . | |
| 0985174 | 7/1951 | France . | |
| 1124600 | 10/1956 | France . | |
| 1304880 | 8/1962 | France . | |
| 1343014 | 10/1963 | France | 280/609 |
| 1423868 | 11/1965 | France . | |
| 2437225 | 4/1980 | France . | |
| 2540391 | 8/1984 | France . | |
| 0525012 | 8/1972 | Switzerland . | |
| 8604824 | 8/1986 | World Int. Prop. O. . | |

*Primary Examiner*—Richard A. Bertsch
*Assistant Examiner*—Michael Mar
*Attorney, Agent, or Firm*—Sandler, Greenblum & Bernstein

[57] ABSTRACT

A ski includes a longitudinally extending body defining a longitudinal median plane and having a sole substantially perpendicular to said plane and adapted to slidably engage a surface, the sole having a central zone lying between front and rear contact zones. The body has opposite side exterior surfaces and comprises a core which extends substantially the entire length of the body, and a plurality of elements operatively associated with the core, the elements including mechanical reinforcing elements, viscoeleastic shock absorption elements, and filling elements connecting the reinforcing elements to the other elements. The shock absorption elements are continuous and extend substantially over the entire length of the body of the ski. The shock absorption elements are constructed and arranged so that the mechanical shock absorption property of the ski at a given location along the length of the ski is a function of the given location.

56 Claims, 7 Drawing Sheets

SKI WITH DISTRIBUTED SHOCK ABSORPTION

1. TECHNICAL FIELD

The present invention generally relates to skis used for winter sports, which are adapted to slide on snow and ice.

2. BACKGROUND ART

A ski generally comprises a lower sliding surface having an angle iron on each lateral side edge for engaging snow, two lateral side surfaces defining the width of the ski, and an upper surface having means, located in a central or binding zone, by which a user attaches his foot to the ski. The leading end of the ski is usually curved upwardly in the form of a spatula; and the ski is relatively narrow in width compared to its length which defines a longitudinal direction.

In conventional skis, the thickness of the body of a ski varies along the length of the ski in the longitudinal direction, having a maximum in the binding zone where the flexional moments are generally greatest during use of the ski. Because the thickness of the ski near its central zone is a maximum, and the thickness near each of the front and rear ends of the skis a minimum, a uniform load distribution is achieved as disclosed in French Patent No. 985,174 for example.

Furthermore, French Patent Application Nos. 86 07 849, 86 07 850, 86 07 851 and 86 07 852, disclose skis whose lateral surfaces or edges of the skis have variable inclinations that vary length-wise along the ski. The contact of these edges with the snow achieves desirable results, particularly during the execution of turns.

Conventional skis generally have a composite structure in which different materials are combined in a manner such that each of the materials operates in an optimal fashion taking into account the distribution of the mechanical stresses in the skis. The composite structure comprises resistance or reinforcing elements or layers formed from material having a high mechanical resistance to strain and a substantial rigidity so as to resist the flexional and torsional stresses produced in a ski during its use. The conventional structure further includes filler elements and absorption elements.

The two principle modern composite structures currently finding wide scale application in skis are the so-called casing structure and sandwich structure. In a typical casing structure, such as described in French Patent No. 985,174 and FIG. 3 of French patent No. 1,124,600, a ski comprises an internal core made of cellular material which may be partially hollow, and resistance elements surrounding the core in the form of layers that constitute a casing for the core.

In a typical sandwich structure, such as described in U.S. Pat. No. 4,405,149, a ski comprises a central core formed from cellular material which can be partially hollow, and reinforcements on its upper and lower surfaces formed by resistance layers having resistance and rigidity properties greater than those of the core itself. Typically, discontinuous strips of stressed viscoelastic material are bonded to the core along two or three separate, longitudinally spaced zones. At least one of these zones is near the spatula of the ski, and another of the zones is located adjacent the binding zone.

Swiss Patent No. 525,012 discloses longitudinal strips formed of viscoelastic material bonded to the upper surface of the ski to form a sandwich structure.

In all known skis utilizing a sandwich construction in which viscoelastic strips are the shock absorption elements, the strips have a uniform width along their entire length. When the strips are positioned substantially over the entire length of a ski, it has been found that skiing comfort is increased, but that the gripping and holding power of the ski during turning maneuvers are reduced. In efforts to solve this problem, it has been proposed to limit the length of the shock absorber to the front half of a ski, i.e., to the zone located between the spatula and the binding zone. Such an expedient, however, appears to provide no advantage over a construction in which the shock absorber extends over the entire length of the ski. Finally, where the strip is segmented or divided into a plurality of separate segments, as described in U.S. Pat. No. 4,405,149, the shock absorption effect is reduced, and the influence of the segments becomes practically negligible at the vibration frequencies produced in a ski in normal use when a boot is attached to the ski by a binding.

Further, in conventional skis using a sandwich construction, the shock absorption element constitutes a supplemental element which complicates the manufacture of the ski and substantially increases its cost.

An object of the present invention is, therefore, to provide a new and improved ski which avoids the disadvantages of known ski structures and has improved shock absorption that increases the comfort of the user and improve technical performance. The most troublesome vibrations that appear when traditional skis are used are sufficiently reduced by the present structure so as to be imperceptible. Simultaneously, the absence of vibration in the same range of frequencies produces a substantial increase in the gripping effect of the ski in ice or snow, in its stability on bumps, in its stability in turning, and, finally, during sliding.

Another object of the present invention is to provide a ski having a sandwich or casing structure capable of conferring to the body of the ski, shock absorption properties at longitudinal locations along the length of the ski which are functionally related to the longitudinal locations.

Another object of the present invention is to provide a ski that has shock absorption properties that vary longitudinally along the ski in order to provide a ski having a desired homogeneity of both structure and behavior, and a good distribution of reactions along the length of the ski, thereby providing a user with a desired comfort level and uniformity in reaction of the ski to stresses.

Another object of the present invention is to provide a ski having both improved shock absorption properties and improved snow reaction properties.

DISCLOSURE OF INVENTION

A ski, according to the present invention, includes a longitudinally extending body defining a longitudinal median plane and having a sole substantially perpendicular to said plane and adapted to slidably engage a surface, said sole having a central zone lying between front and rear contact zones. The body has opposite side exterior surfaces and comprises a core which extends substantially the entire length of the body, and a plurality of elements operatively associated with said core, said elements including mechanical reinforcing elements, viscoelastic shock absorption elements, and filling elements connecting the reinforcing elements to the other elements. The shock absorption elements are continuous and extend substantially over the entire length of the body of the ski, and are constructed and arranged so that the mechanical shock absorption property of the ski at a given location along the length of the ski is a function of said given location.

Preferably, the transverse cross-section of the shock absorption elements of the ski varies along the length of the the ski. In addition, the cross-sectional area of the shock absorption elements in the central zone is less than the cross-sectional area of the shock absorption elements located between the central zone and the front and rear contact zones.

The the filling elements of the ski are preferably constituted by viscoelastic material.

In a first preferred embodiment of the invention, the shock absorption elements include two laterally displaced volumes of viscoelastic material respectively positioned on opposite sides of the core. In such case, the filling elements include an upper linking layer of viscoelastic material connecting said two volumes. Alternatively, the filling elements may include a lower linking layer of viscoelastic material connecting said two volumes. And in a further alternative arrangement, the filling elements may include an upper linking layer of viscoelastic material and a lower linking layer of viscoelastic material for connecting said two volumes.

In a second preferred embodiment, the core comprises laterally spaced portions located on opposite sides of said median plane of the ski, and the shock absorption elements comprise a central volume of viscoelastic material positioned between said spaced portions.

The invention also consists in having the core substantially uniform in cross-section throughout its length. Furthermore, the core is advantageously symmetrically located with respect to the median plane of the ski. In one modification, each of said laterally disposed volumes of viscoelastic material has an outside lateral surface substantially parallel to the adjacent exterior side surface of the ski.

In one aspect of the invention, a side surface of the ski forms an effective inclination angle A with the sole of the ski, the angle A in the central zone of the ski being greater than the angle A near the front contact zone of the ski. In another aspect of the invention, the angle A in the central zone of the ski is greater than the angle A near the rear contact zone of the ski. In a further aspect of the invention, the angle A in the central zone of the ski is greater than the angle A near both the front and rear contact zones of the ski.

The invention also consists in providing for the sides of the ski to be symmetrical with respect to the median plane, or providing for the sides to be asymmetrical. Preferably, the effective inclination angle A in the central zone of the ski is about 90°. The angle A near one of the contact zones is preferably less than about 10°.

Preferably, the angle A varies in a continuous fashion along the length of the ski.

It is also preferred for the mechanical reinforcing elements to comprise upper and lower reinforcing elements sandwiching the core. In one modification, the reinforcing elements include the opposite exterior walls such that the reinforcing elements form a casing structure.

BRIEF DESCRIPTION OF THE DRAWINGS

Embodiments of the present invention are shown in the accompanying drawings wherein.

BEST MODE FOR CARRYING OUT THE INVENTION

Figure 1:
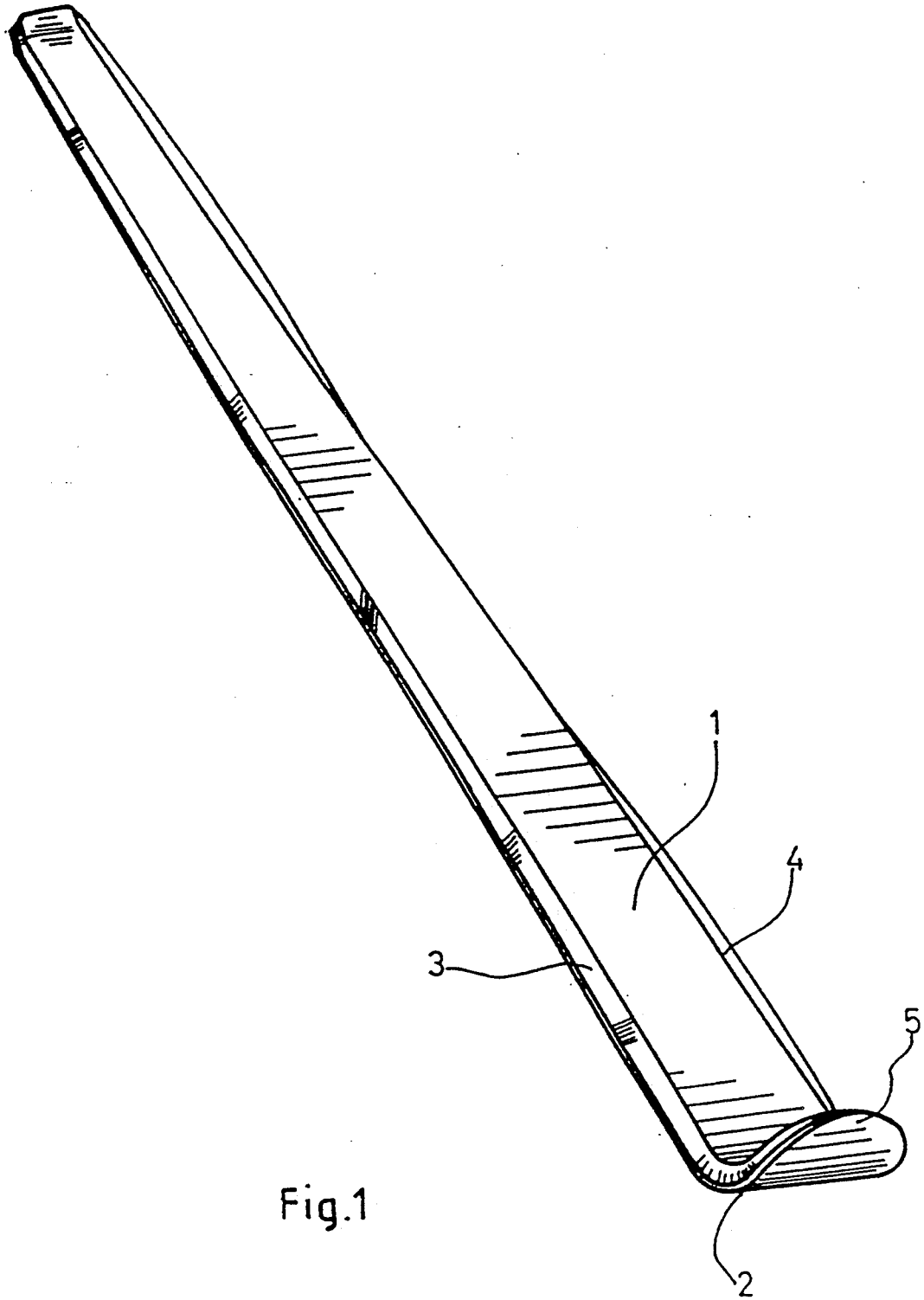
FIG. 1 is a perspective view of a first embodiment of a ski according to the present invention.

The present invention provides a ski comprising a longitudinal body having a core which extends substantially the length of the body, mechanical resistance elements, internal longitudinal shock absorber elements, and filler material for connecting the various elements. The internal shock absorption elements, of viscoelastic material, are continuous over substantially the entire length of the body of the ski, and have a cross-section that varies along the length thereof. With such an arrangement, the mechanical shock absorption properties at a given longitudinal location along the ski are functionally dependent on the given longitudinal location thereby substantially increasing the effectiveness of shock absorption over a greater range of frequencies.

In accordance with a preferred embodiment of the invention, the cross-section of a shock absorption element in the central zone and near the ends of the ski is less than the cross-section of the same shock absorption element near the front and rear quarters of the contact zone of the ski. The shock absorption is thus maximized in the binding zone of the ski where most stress occurs.

According to a particularly advantageous embodiment of the invention, the shock absorption elements comprise filling elements of viscoelastic material. In such an embodiment, the structure of the ski is considerably simplified.

The variable cross-section of the shock absorption elements may be achieved by providing a core of constant width, and shock absorption elements on each side of the core, the lateral width of the elements being limited by the spacing between the core and the sides of the ski, and the height of the elements being limited by the upper and lower surfaces of the ski. The conventional variation in width of the ski, which is greater in the central or binding zone of the ski than at the ends of the ski, cooperate with the shock absorption elements to provide a suitable variation in cross-section of the shock absorption elements which closely matches the desired variation in shock absorption properties.

Preferably, the variation in cross-section of the shock absorption elements is achieved when the inclination angle A of a lateral edge of the ski relative to the lower surface of the ski is acute and varies longitudinally along the length of the ski. Such a variable shock absorption structure is applicable to both a sandwich-type structure and a casing-type structure. Thus, the gripping qualities of a ski can be increased by combining the intrinsic qualities of the casing and the anti-vibration effect of the structure formed in accordance with the present invention.

The desired distributed shock absorption properties may be obtained by positioning shock absorption elements symmetrically with respect to the median longitudinal plane of the ski. Alternatively, the desired distribution can be obtained when the shock absorber elements are asymmetrical, the asymmetry being achieved by the asymmetrical location of the elements relative to the median longitudinal plane of the ski, or by the asymmetrical length-wise nature of the elements themselves.

In accordance with one embodiment, the inclination angle A does not exceed about 90° over the entire length of the casing. Preferably, inclination angle A may approach 90° along the central zone of the ski body, thus achieving the maximum effect of a casing-type ski structure. However, near at least one of the two contact zones of the ski, inclination angle A is preferably smaller, and in particular, less than about 10°.

Preferably, the cross-section of the shock absorption element varies continuously in the length-wise direction thereby producing a continuous variation in the mechanical shock absorption characteristics of the ski.

According to one embodiment of the invention, shock absorption elements have exterior lateral surfaces which are substantially parallel to the corresponding exterior lateral surfaces of the ski. This arrangement combines the desired shock absorption characteristics with the beneficial effect the exterior shape of the ski has on executing turns.

Figure 3:
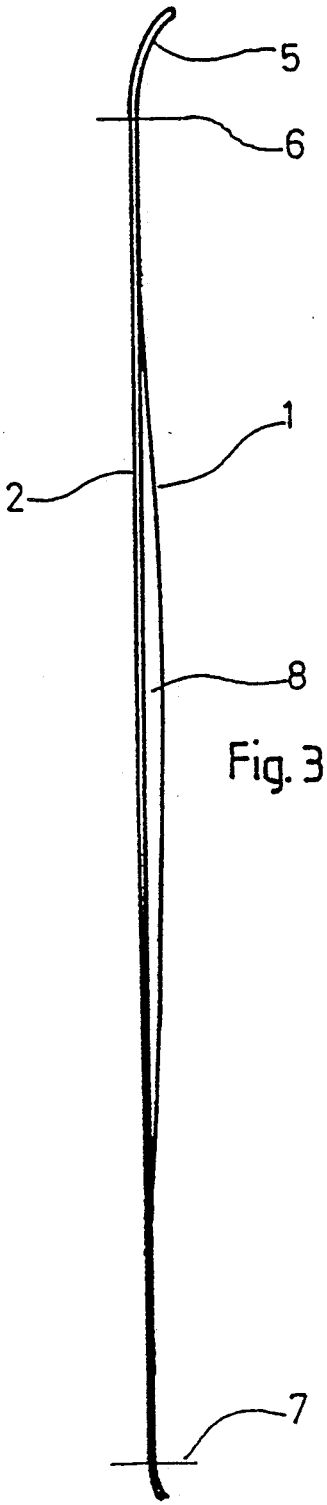
FIG. 3 is a side view of the ski shown in FIG. 1.
Figure 2:
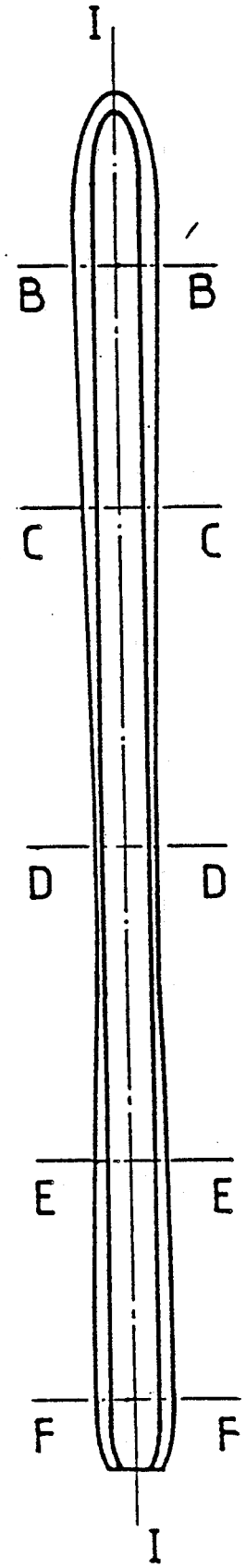
FIG. 2 is a top view of the ski shown in FIG. 1.
Figure 4:
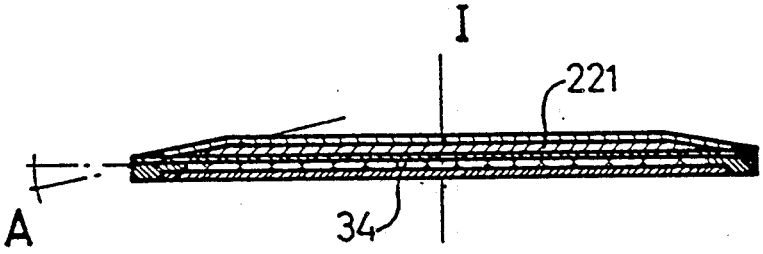
FIGS. 4–8 are transverse cross-sections of the ski shown in FIG. 2 taken along lines B—B, C—C, D—D, E—E, and F—F, respectively.

Referring now to FIGS. 1 and 3 of the drawing, a ski in accordance with the present invention comprises, in general, upper surface 1, a sole in the form of a lower or sliding surface 2, first lateral surface 3, second lateral surface 4, and front end 5 upwardly curved in the general configuration of a spatula. Lower ski surface 2 is arched upwardly between front contact zone 6 and rear contact zone 7. The body of the ski, or that portion of the ski between the front and rear contact zones, has a maximum thickness along in central zone 8. The thickness of the ski thus progressively decreases from zone 8 toward each of zones 6 and 7, contact line 6 and rear contact line 7.

Figure 5:
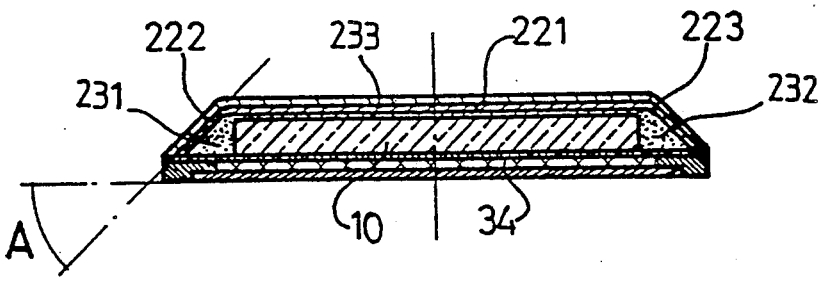
Figure 6:
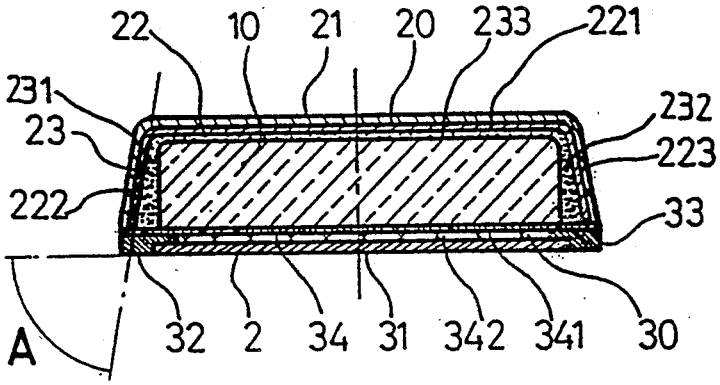

In the embodiment illustrated in FIGS. 4–8, the ski has a mechanical resistance casing structure which is symmetrical with respect to the longitudinal vertical median axis I—I of the ski through which passes a longitudinal plane that is perpendicular to surface 2. FIG. 6 is a transverse cross-section of the ski near central zone 8 taken along line D—D. As shown in this cross-section, the ski comprises four principal portions: core 10 having a substantially rectangular cross-section, shell 20, lower element 30, and filling layer 23 (FIG. 6).

Core 10 may be a cellular structure such as wood, synthetic foam, or aluminum honey-comb. The core may be partially hollow and may be constituted, for example, by metallic or plastic tubes.

Shell 20, in this embodiment, is a composite shell comprising outer exterior layer 21 of thermoplastic material, for example, and reinforcement layer 22 constituted from a material having high mechanical resistance such as stratified or alloyed aluminum, for example.

Exterior layer 21 may be a thermoplastic material such as ABS (acrylonitrile butadiene styrene), a polyamide, or a polycarbonate.

Reinforcement layer 22 may be one or more sheets or layers of woven glass, carbon or other material, these layers preferably being pre-impregnated with a thermoplastic resin such as a polyetherimide, or with a thermosetting resin such an epoxyde, or a polyurethane. The fabric is preferably oriented, and may have 90° of its fibers arranged in the longitudinal direction of the ski, and 10° in the transverse direction of the ski.

Interior filling layer 23, of viscoelastic material, ensures a linkage or connection between core 10 and reinforcement layer 22. The application to skis of viscoelastic material to provide shock absorption is described in the previously noted patents identified above. As is known, a suitable viscoelastic material can be selected from thermoplastic materials, synthetic resins, silicon elastomers, rubbers, butyl polychloroprenes, acrylic nitriles, ethylenes, propylenes, and ionomers. Such viscoelastic materials have properties that lie between those of a solid and a liquid, and serve to at least partially absorb shock and deformation forces. In liquids, stress is directly proportional to the rate of deformation; and in solids, stress is directly proportional to deformation. In a viscoelastic material, however, stress is a function of both the rate of deformation and of the deformation itself. In all of the embodiments, viscoelastic filling layer 23 is securely attached to the mechanical resistance elements by bonding or any other known process.

Lower element 30 comprises sole 31 of polyethylene constituting lower or sliding surface 2 of the ski. Lateral angles 32 and 33 are of steel; and lower resistance layer 34 is a mechanically resistant material. For example, lower resistance layer 34 may have a composite structure comprising lower layer 341 of glass fibers and upper layer 342 of aluminum alloy or stratified aluminum. Lower resistance layer 34 is integrated along its lateral edges with with the corresponding lower lateral edges of reinforcement layer 22 of shell 20.

Reinforcement layer 22 of shell 20 has, as shown in the drawings, a cross-section in the form of an inverted U-shaped structure which constitutes upper resistance layer 221 connected to two lateral resistance walls 222 and 223 attached at their lower edges to the lateral edges of lower resistance blade 34. As a result, reinforcement layer 22 of the shell and of the lower resistance layer 34 comprise an enclosed casing structure that surrounds core 10.

As best shown in FIGS. 4–8, the shape and the dimensions of the cross-section of the casing at a given location along the length of the ski vary as a function of the location. In the central zone shown in FIG. 6, the casing has a trapezoidal cross-section wherein lateral resistance walls 222 and 223 are slightly inclined with respect to the longitudinal median plane of the ski passing through axis I—I of the ski. Thus, lateral resistance walls 222 and 223 define, together with lower resistance layer 34, an interior or inclination angle A having a value close to about 90°.

Figure 7:
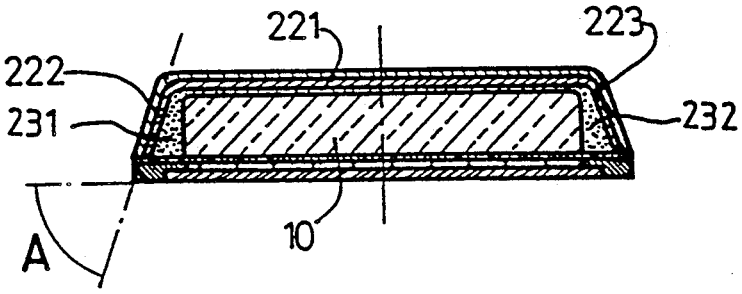
Figure 8:
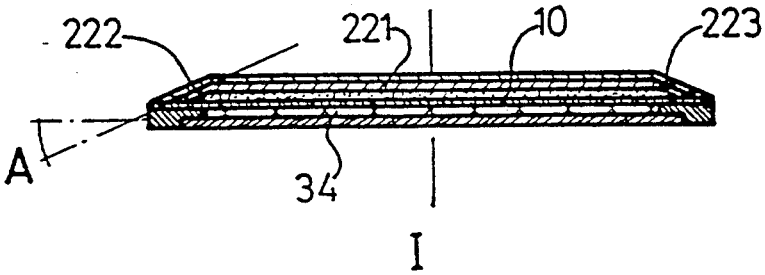

In FIG. 7, which shows rear intermediate zone E—E of the ski, the height of the casing is reduced compared to the height in zone D—D; and the inclination angle is also reduced, for example to about 70°. In the vicinity of the rear contact zone F—F of the ski, FIG. 8 shows that the casing is very much flattened and its thickness is very small compared to the thickness of the binding zone of the ski. Thus, in the rear contact zone, inclination angle A is also relatively small, for example, about 10°–°°. Core 10 has a very thickness in this embodiment.

Likewise, along the front intermediate zone of the ski shown in FIG. 5, or the zone taken along line C—C, the casing has a reduced height and the inclination angle A is small, for example, about 45°.

Near front contact zone 6, the casing is very flattened and is constituted by two resistance layers, the upper and lower ones being bonded one to the other. In this zone, the inclination angle A may vary from 0° to about 10°.

The structure of FIG. 6 is a traditional casing structure. The structures at both the front and rear contact zones shown in FIGS. 4 and 8, respectively, even though they are in the shape of a casing, function as a sandwich-type structure because inclination angle A in these zones is small. The transition in function from one structure to the other occurs gradually, by progressive diminution of the thickness of the ski and simultaneous diminution of inclination angle A in passing from the central zone of the ski shown in FIG. 6 to an end zone shown in either of FIGS. 4 or 8.

In the embodiment shown, the thickness of core 10 at a given position along the length of the ski varies as a function of the location of the given position; but the core has a constant width. Therefore, viscoelastic filling layer 23 has a first, lateral left volume 231 that is triangular in cross-section, a second, lateral right volume 232 that is also triangular in cross-section, and an upper or third portion 233 in the form of a layer interconnecting volume 231 and 232. Both the inclination of and the spacing between lateral resistance walls 222 and 223 vary along the length of the ski. This variation establishes a variation in the shape and the cross-section of lateral volumes 231 and 232 formed of viscoelastic material. For example, the cross-section of viscoelastic material near the front and rear quarters of the ski, as shown in FIGS. 5 and 7, is greater than in the central zone illustrated in FIG. 6.

The presence of exterior layer 21 is not necessary to obtain the particular effects desired in accordance with the invention. A ski structure in accordance with the present invention may combine exterior layer 21 and reinforcement layer 22 into a single reinforcement layer.

Figure 9:
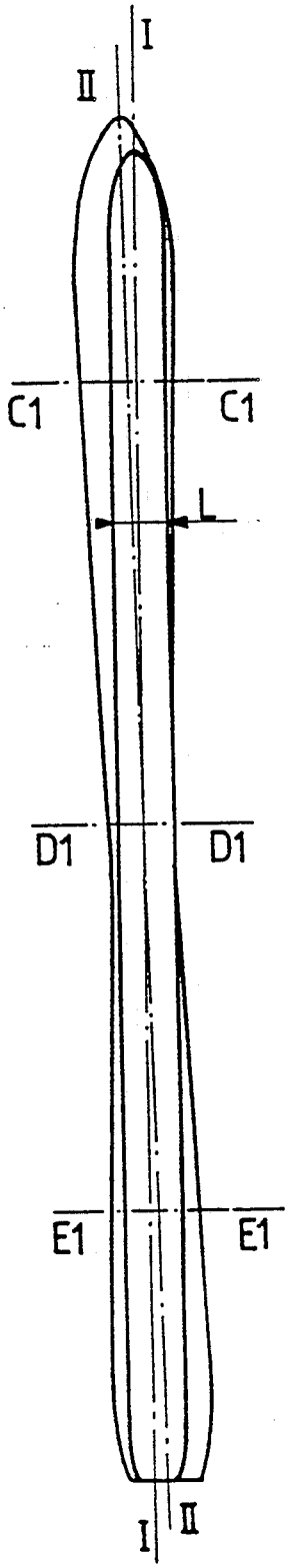
FIG. 9 is a top view of a second embodiment of a ski according to the present invention, the ski having an asymmetrical cross-section which varies as a function of the longitudinal portion of the ski being considered.
Figure 10:
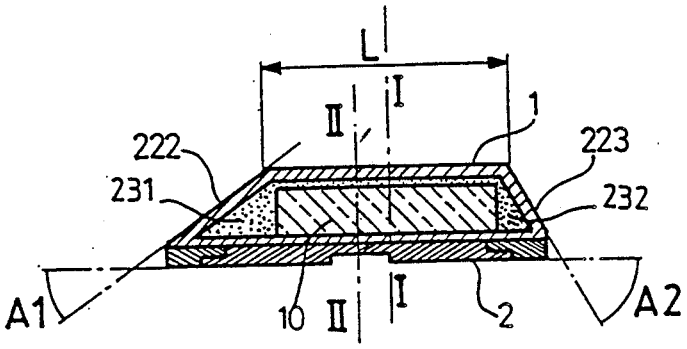
FIGS. 10–12 are transverse cross-sections of the ski of FIG. 9 taken along lines C1—C1, D1—D1, and E1—E1, respectively.
Figure 11:
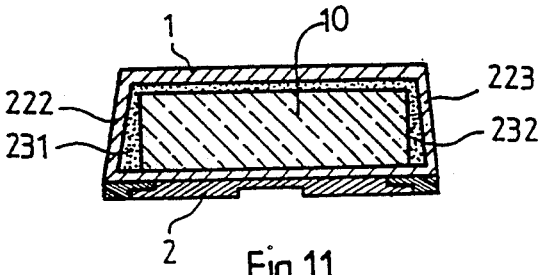
Figure 12:
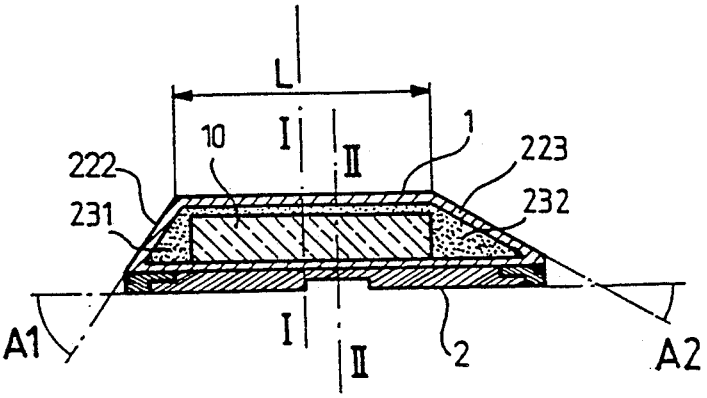

The same variations described above with respect to a ski with a symmetrical cross-section also can be applied to the embodiments described hereinafter wherein the ski has an asymmetrical structure. In the embodiment illustrated in FIGS. 9–12, a ski formed according to the present invention has an asymmetrical cross-section that varies in the longitudinal direction of the ski. As shown in FIG. 10, which is a cross-section taken along the line C1—C1 of FIG. 9 and shows the front zone of the ski, left lateral resistance wall 222 of the casing has an inclination angle A1 less than the inclination angle A2 of right lateral resistance wall 223; and left viscoelastic volume 231 is greater than right volume 232. On the other hand, along the rear zone, whose cross-section is shown in FIG. 12, angle A1 is greater than angle A2, and left volume 231 is less than right volume 232. In the central zone of the ski, whose cross-section is shown in FIG. 11, angles A1 and A2 are equal; and the viscoelastic volume is a minimum on each side.

Figure 13:
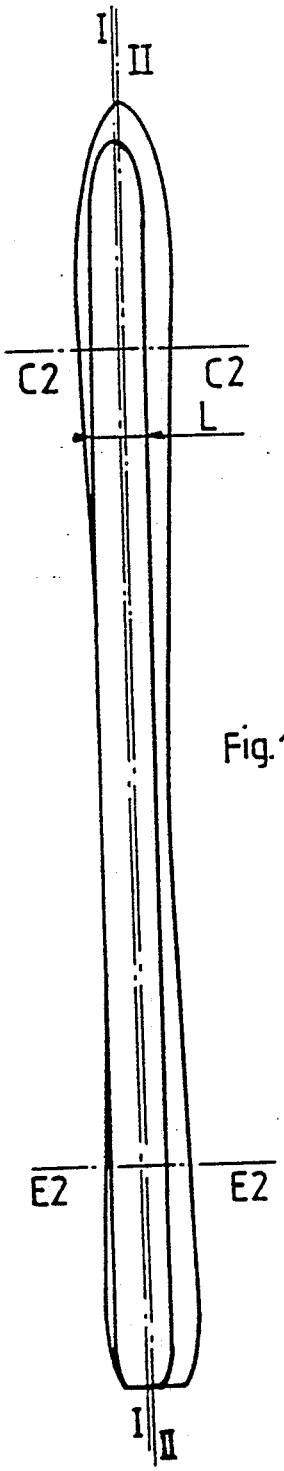
FIG. 13 is a top view of another embodiment of a ski according to the present invention having an asymmetrical cross-section different from that shown in FIG. 9 and showing a lateral translation of the upper surface of the ski with respect to the lower surface thereof.
Figure 14:
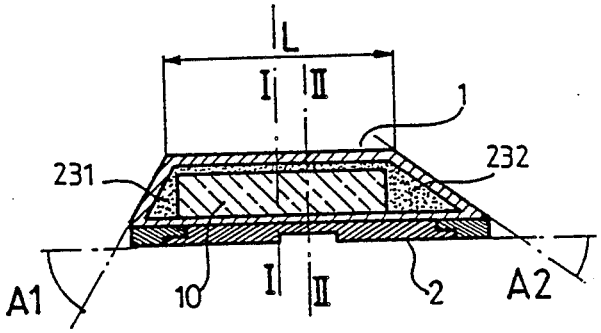
FIGS. 14 and 15 are respective cross-sections of the ski of FIG. 13 taken along lines C2—C2, and E2—E2.
Figure 15:
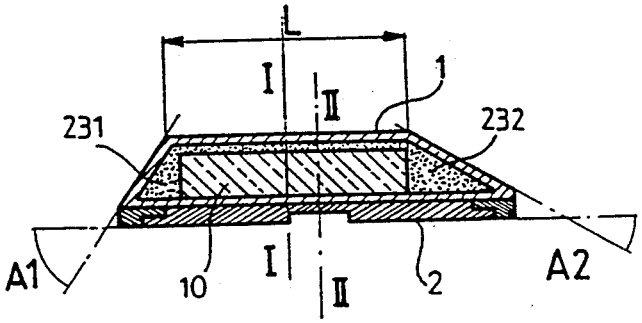

In the embodiment illustrated in FIGS. 13–15, the cross-section of the ski is also asymmetrical, and the asymmetry is in the same direction with respect to the longitudinal median plane of the ski. In the embodiment of FIGS. 13–15, however, inclination angle A1 is greater than inclination angle A2 over the entire length of the ski, and the left viscoelastic volume 231 at each location along the length of the ski has a smaller cross-section than the corresponding right volume 232. Of course, in the preceding two embodiments, each of the angles A1 and A2 varies as a function of the position being considered along the ski, and the variation is of the same type as the variation of the embodiment of FIGS. 1–8. In other words, in the central zone, the angle is a maximum, and decreases towards the two opposed ends of the ski.

Figure 16:
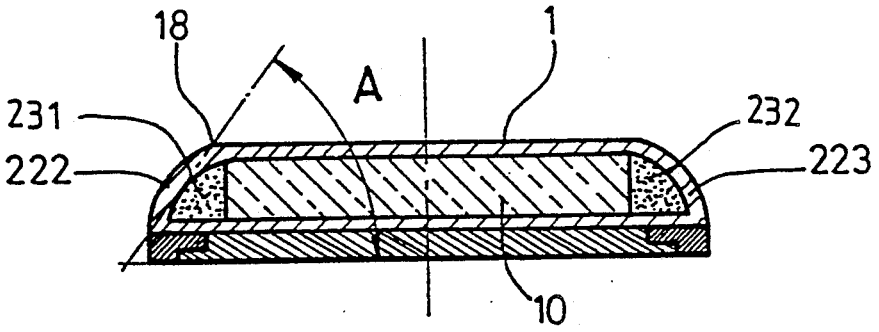
FIG. 16 is a further embodiment according to the present invention in which the lateral surfaces of the casing are substantially convex.
Figure 17:
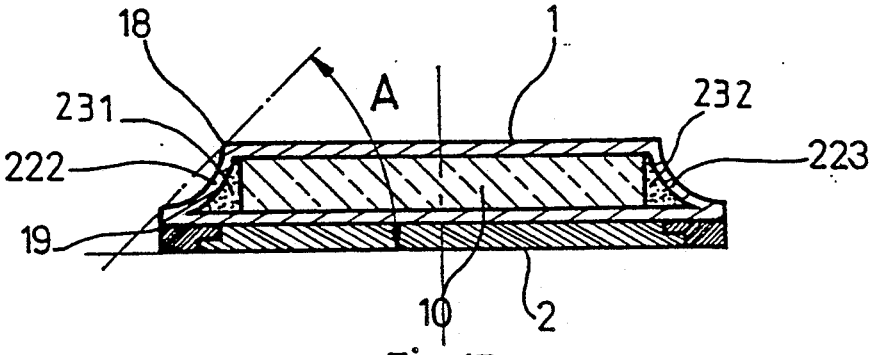
FIG. 17 is a further embodiment of the present invention in which the lateral surfaces of the casing are substantially concave.
Figure 18:
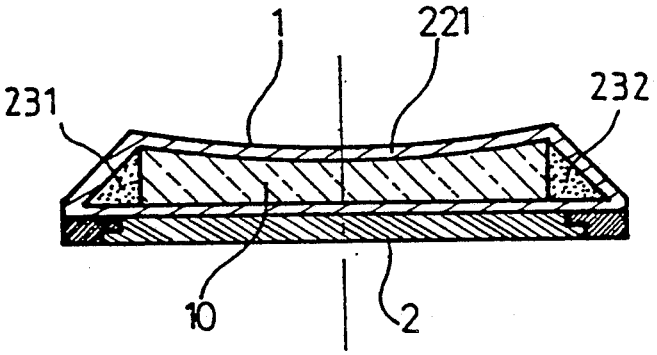
FIG. 18 is a further embodiment of the present invention in which the upper surface of the casing is substantially concave.

FIGS. 16–18 illustrate several other alternatives of the longitudinal profile of the casing according to the invention. Thus, in FIG. 16, the lateral resistance walls 222 and 223 are convex, for example, in the form of a portion of a cylinder. In FIG. 17, the lateral resistance walls 222 and 223 are concave. Although the walls 222 and 223 may be curved as shown in FIGS. 16 and 17, even the curved walls define an effective angle A as indicated. In FIG. 18, the upper resistance layer is concave, while in the preceding embodiments it was substantially planar and simply longitudinally curved upwardly.

In the embodiments shown, the lateral resistance walls 222 and 223 are substantially parallel to respective lateral exterior surfaces 4 and 3 of the ski; and, in certain embodiments, these walls constitute by themselves the same lateral exterior surfaces. The inclination of the lateral resistance walls and the variation inclination as a function of length serve to modify the behavior of the casing of the ski for longitudinal sliding and transverse gripping in the snow, and of the behavior of the ski connected to the form of the lateral surfaces of the ski.

The preceding embodiments have been described with respect to a mechanically resistant casing structure. It is possible to apply this structure according to the present invention so as to include shock absorption elements, in the case of a mechanically resistant structure of the sandwich-type.

Figure 19:
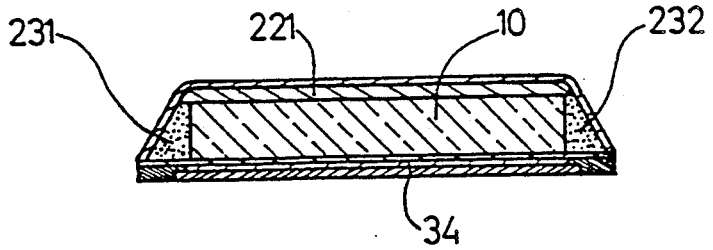
FIG. 19 is a cross-section of another embodiment of the invention in which a sandwich structure is provided.

FIG. 19 shows a transverse cross-section of a ski having a sandwich structure in which central core 10 is maintained in position between upper resistance layer 221 and the lower resistance layer 34 by two lateral viscoelastic volumes 231 and 232. As in the preceding embodiments, the cross-section of lateral volumes 231 and 232 at a given longitudinal location of the ski varies as a function of the location, along the length of the ski.

Figure 20:
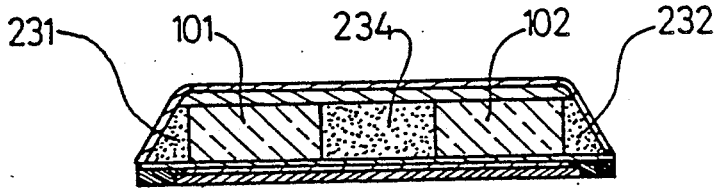
FIG. 20 is a cross-section of yet another embodiment of the invention which includes two laterally offset cores and a central shock absorber portion.

FIG. 20 illustrates an alternative embodiment of the present invention in which the structure includes a double core: left lateral core portion 101 and right lateral core portion 102. These portions are laterally offset relative to the longitudinal median plane of the ski, and are separated by a median volume 234 formed from a viscoelastic material. Left and right volumes 231, 232, and median volume 234, are all made from viscoelastic material and have cross-sections that vary in the longitudinal direction of the ski.

Figure 21:
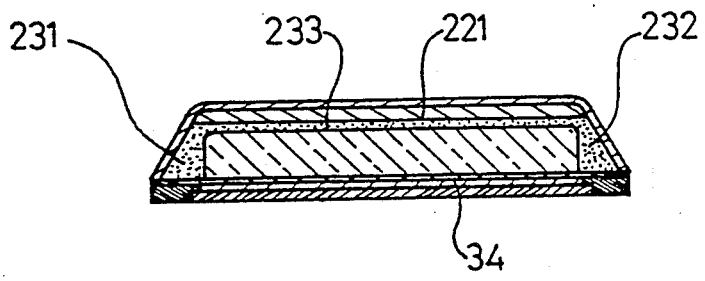
FIG. 21 is a cross-section of another embodiment of the invention which includes a sandwich structure in which two longitudinal shock absorption elements are connected by an intermediate shock absorption plate.

FIG. 21 illustrates a cross-section of a ski in an embodiment in which the mechanically resistant structure is a sandwich-type having upper resistance layer 221 and lower resistance layer 34. Two laterally displaced viscoelastic volumes 231 and 232, each having a triangular cross-section, are interconnected by an upper viscoelastic layer 233.

Figure 22:
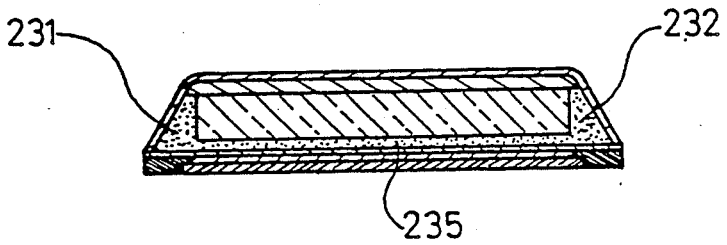
FIG. 22 is a cross-section of another embodiment of the invention in which two longitudinal shock absorbers are connected by a lower shock absorption layer.

FIG. 22 illustrates an alternative embodiment in which the viscoelastic material comprises two laterally displaced volumes 231, 232 of triangular cross-section interconnected by a lower layer 235.

Figure 23:
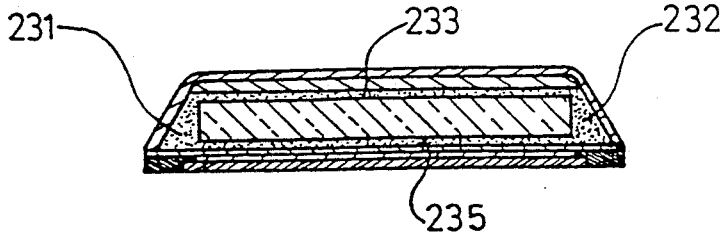
FIG. 23 is a cross-section of another embodiment of the invention in which two longitudinal shock absorbers are connected by upper and lower shock absorption layers.

FIG. 23 illustrates an embodiment of the present invention in which the viscoelastic material comprises two laterally displaced volumes 231, 232 of triangular cross-section interconnected by upper layer 233 and lower layer 235. These two alternate structures, as well as the double core embodiment, are equally applicable in the case of casing resistance structures.

A ski according to the present invention can be manufactured by conventional means, for example, by a process described in French Document 985 174. However, a ski formed in accordance with the present invention can similarly be formed in accordance with the process described in French Patent Application No. 8703119, filed on even date by the present assignee, the disclosure of which is hereby incorporated by reference.

The advantages and improved results achieved by the apparatus of the present invention are apparent from the foregoing description of the preferred embodiment of the invention. Various changes and modifications may be made without departing from the spirit and scope of the invention as described in the claims that follow.

We claim:

1. A ski comprising:

(a) a longitudinally extending body defining a longitudinal median plane and having a sole substantially perpendicular to said plane and adapted to slidably engage a surface, said sole having a central zone lying between front and rear contact zones;

(b) said body including a shell joined to said sole and having a top exterior surface and opposite side exterior surfaces, a core which extends substantially the entire length of the body, and a plurality of elements operatively associated with said care, said elements including mechanical reinforcing elements, viscoelastic shock absorption elements, and filling elements, said filling elements connecting said reinforcing elements to said viscoelastic elements;

(c) said shock absorption elements being continuous and extending substantially over the entire length of the body of the ski, and being constructed and arranged so that the mechanical shock absorption property of the ski varies along the length of the ski as a function of the length of the ski; and (d) wherein the transverse cross-sectional area of said shock absorption elements varies along the length of the ski.

2. A ski according to claim 1 wherein the filling elements are constituted by viscoelastic material.

3. A ski according to claim 1 wherein the filling elements are constituted by viscoelastic material.

4. A ski according to claim 1 wherein said core is symmetrically located with respect to the median plane of the ski and is of uniform cross-section.

5. A ski comprising:

(a) a longitudinally extending body defining a longitudinal median plane having a sole substantially perpendicular to said plane and adapted to slidably engage a surface, said sole having a central region lying between front and rear contact zones;

(b) said body including a shell joined to said sole and having a top exterior surface and opposite side exterior surfaces, a core which extends substantially the entire length of the body, and a plurality of elements operatively associated with said core, said elements including mechanical reinforcing elements, viscoelastic shock absorption elements, and filling elements, said filling elements connecting said reinforcing elements to said viscoelastic elements;

(c) said shock absorption elements being continuous and extending substantially over the entire length of the body of the ski, and being constructed and arranged so that the mechanical shock absorption property of the ski at a given location along the length of the ski is a function of said given location;

(d) wherein the transverse cross-sectional area of said shock absorption elements varies along the length of the ski; and (e) wherein the transverse cross-sectional area of the shock absorption elements in the central region is less than the transverse cross-sectional area of the shock absorption elements located between the central region and the front and rear contact zones.

6. A ski according to claim 5 wherein the filling elements are constituted by viscoelastic material.

7. A ski comprising:

(a) a longitudinally extending body defining a longitudinal median plane having a sole substantially perpendicular to said plane and adapted to slidably engage a surface, said sole having a central region lying between front and rear contact zones;

(b) said body including a shell joined to said sole and having a top exterior surface and opposite side exterior surfaces, a core which extends substantially the entire length of the body, and a plurality of elements operatively associated with said core, said elements including mechanical reinforcing elements, viscoelastic shock absorption elements, and filling elements, said filling elements connecting said reinforcing elements to said viscoelastic elements;

(c) said shock absorption elements being continuous and extending substantially over the entire length of the body of the ski, and being constructed and arranged so that the mechanical shock absorption property of the ski at a given location along the length of the ski is a function of said given location;

(d) wherein the transverse cross-sectional area of said shock absorption elements varies along the length of the ski; and wherein the transverse cross-sectional area of the shock absorption element located in each of front and rear quarters of the ski between the central region and the front and rear contact zones respectively is greater than the transverse cross-sectional area of the shock absorption element located in the central region and the front and rear contact zones.

8. A ski according to claim 7 wherein the filling elements are constituted by viscoelastic material.

9. A ski comprising:

(a) a longitudinally extending body defining a longitudinal median plane having a sole substantially perpendicular to said plane and adapted to slidably engage a surface, said sole having a central region lying between front and rear contact zones;

(b) said body including a shell joined to said sole and having a top exterior surface and opposite side exterior surfaces, a core which extends substantially the entire length of the body, and a plurality of elements operatively associated with said core, said elements including mechanical reinforcing elements, viscoelastic shock absorption elements, and filling elements, said filling elements connecting said reinforcing elements to said viscoelastic elements;

(c) said shock absorption elements being continuous and extending substantially over the entire length of the body of the ski, and being constructed and arranged so that the mechanical shock absorption property of the ski at a given location along the length of the ski is a function of said given location;

(d) wherein the transverse cross-sectional area of said shock absorption elements varies along the length of the ski; and wherein said shock absorption elements include two laterally displaced volumes of viscoelastic material respectively positioned on opposite sides of said core.

10. A ski according to claim 9 wherein said filling elements include an upper linking layer of viscoelastic material connecting said two volumes.

11. A ski according to claim 9 wherein said filling elements include a lower linking layer of viscoelastic material connecting said two volumes.

12. A ski according to claim 9 wherein said filling elements include an upper linking layer of viscoelastic material and a lower linking layer of viscoelastic material for connecting said two volumes.

13. A ski according to claim 12 wherein said core has a substantially uniform cross-section throughout its length.

14. A ski according to claim 9 wherein said core comprises laterally spaced portions located on opposite sides of said median plane, and said shock absorption elements comprise a central volume of viscoelastic material positioned between said spaced portions.

15. A ski according to claim 14 wherein said shock absorption elements include two laterally spaced volumes of viscoelastic material positioned on the outer, opposite sides of said spaced portions of said core.

16. A ski according to claim 15 wherein said reinforcing elements include an upper layer connecting said spaced portions of said core and the volumes of said shock absorption elements.

17. A ski according to claim 15 wherein each of said laterally disposed volumes of viscoelastic material has an outside lateral surface substantially parallel to the adjacent exterior side surface of the ski.

18. A ski according to claim 14 wherein each portion of said core is of uniform cross-section.

19. A ski according to claim 14 wherein a side surface of the ski forms an effective inclination angle A with the sole of the ski, the angle A in the central zone of the ski being greater than the angle A near the front contact zone of the ski.

20. A ski according to claim 14 wherein a side surface of the ski forms an effective inclination angle A with the sole of the ski, the angle A in the central zone of the ski being greater then the angle A near the rear contact zone of the ski.

21. A ski according to claim 14 wherein a side surface of the ski forms an effective inclination angle A with the sole of the ski, the angle A in the central zone of the ski being greater than the angle A near both the front and rear contact zones of the ski.

22. A ski according to claim 14 wherein the sides of the ski are symmetrical with respect to the median plane.

23. A ski according to claim 22 wherein a side surface of the ski forms an effective inclination angle A with the sole of the ski, the angle A in the central zone of the ski being about 90°.

24. A ski according to claim 23 wherein the angle A near one of the contact zones is less than about 10°.

25. A ski according to claim 24 wherein the angle A varies in a continuous fashion along the length of the ski.

26. A ski according to claim 9 wherein the sides of the ski are asymmetrical with respect to the median plane.

27. A ski according to claim 26 wherein a side surface of the ski forms an effective inclination angle A with the sole of the ski, the angle A in the central zone of the ski being about 90°.

28. A ski according to claim 27 wherein the angle A near one of the contact zones is less than about 10°.

29. A ski according to claim 28 wherein the angle A varies in a continuous fashion along the length of the ski.

30. A ski according to claim 14 wherein the sides of the ski are asymmetrical with respect to the median plane.

31. A ski according to claim 30 wherein a side surface of the ski forms an effective inclination angle A with the sole of the ski, the angle A in the central zone of the ski being about 90°.

32. A ski according to claim 31 wherein the angle A near one of the contact zones is less than about 10°.

33. A ski according to claim 32 wherein the angle A varies in a continuous fashion along the length of the ski.

34. A ski according to claim 9 wherein said mechanical reinforcing elements comprise an upper and lower reinforcing elements sandwiching said core.

35. A ski according to claim 14 wherein said mechanical reinforcing elements comprise upper and lower reinforcing elements extending length-wise along said body and sandwiching said core.

36. A ski according to claim 14 wherein said mechanical reinforcing elements comprise upper and lower reinforcing elements extending length-wise along said body and sandwiching said core, and the opposite exterior sides of said body, said said mechanical reinforcing elements forming a casing structure.

37. A ski according to claim 9 wherein said core is symmetrically located with respect to the median plane of the ski and is of uniform cross-section.

38. A ski according to claim 9 wherein each of said laterally disposed volumes of viscoelastic material has an outside lateral surface substantially parallel to the adjacent exterior side surface of the ski.

39. A ski according to claim 9 wherein a side surface of the ski forms an effective inclination angle A with the sole of the ski, the angle A in the central zone of the ski being greater than the angle A near the front contact zone of the ski.

40. A ski according to claim 9 wherein a side surface of the ski forms an effective inclination angle A with the sole of the ski, the angle A in the central zone of the ski being greater than the angle A near the rear contact zone of the ski.

41. A ski according to claim 9 wherein a side surface of the ski forms an effective inclination angle A with the sole of the ski, the angle A in the central zone of the ski being greater than the angle A near both the front and rear contact zones of the ski.

42. A ski according to claim 9 wherein the sides of the ski are symmetrical with respect to the median plane.

43. A ski according to claim 42 wherein a side surface of the ski forms an effective inclination angle A with the sole of the ski, the angle A in the central zone of the ski being about 90°.

44. A ski according to claim 43 wherein the angle A near one of the contact zones is less than about 10°.

45. A ski according to claim 44 wherein the angle A varies in a continuous fashion along the length of the ski.

46. A ski according to claim 9 wherein said mechanical reinforcing elements comprise upper and lower reinforcing elements extending length-wise along said body and sandwiching said core, and the opposite exterior sides of said body, said said mechanical reinforcing elements forming a casing structure.

47. A ski according to claim 9 wherein the top surface of the ski is defined by edges that are parallel to the longitudinal median plane of the ski whereby the width of the top of the ski is substantially constant along its length.

48. A ski according to claim 9 wherein the bottom surface of the ski is wider in the vicinity of the front and rear zones than in the central zone.

49. A ski according to claim 9 wherein the top surface of the ski is defined by edges that are substantially parallel to the longitudinal median plane of the ski, and wherein the bottom surface of the ski is wider in each of the front and rear zones than in the central zone.

50. A ski according to claim 49 wherein the side edges of the ski are symmetrical about a transverse plane passing through the central zone.

51. A ski according to claim 50 wherein the sides of the ski are symmetrical with respect to the longitudinal median plane of the ski.

52. A ski according to claim 51 wherein a side surface of the ski forms an effective inclination angle A with the sole of the ski, the angle A in the central zone of the ski being about 90°.

53. A ski according to claim 52 wherein the angle A near one of the contact zones is less than about 10°.

54. A ski according to claim 53 wherein the angle A varies in a continuous fashion along the length of the ski.

55. A ski according to claim 52 wherein the angle A near the front contact zone is less than about 10°.

56. A ski according to claim 52 wherein the angle A varies symmetrically about a transverse plane passing through the central zone of the ski.

* * * * *